US005194139A

United States Patent [19]

Kinase et al.

[11] Patent Number: 5,194,139

[45] Date of Patent: Mar. 16, 1993

[54] PRETREATING SOLUTION FOR SILVER PLATING AND SILVER PLATING TREATING PROCESS USING THE SOLUTION

[75] Inventors: Takashi Kinase; Yoshiyuki Hisumi, both of Ibaragi, Japan

[73] Assignee: Nippon Mining Company Limited, Tokyo, Japan

[21] Appl. No.: 666,731

[22] Filed: Mar. 8, 1991

[51] Int. Cl.[5] ..... C25D 5/34; C25D 3/41

[52] U.S. Cl. ..... 205/210; 205/219; 205/263

[58] Field of Search ..... 204/29, 46.1; 205/209, 205/210, 219, 263

[56] References Cited

U.S. PATENT DOCUMENTS 3,645,858 2/1972 Dingley et al. ..... 204/46.1

4,452,673 6/1984 Takano ..... 204/29

4,604,167 8/1986 Wakabayashi et al. ..... 204/29

FOREIGN PATENT DOCUMENTS 109191 5/1988 Japan .

2003504 8/1978 United Kingdom .

2141441 6/1984 United Kingdom .

*Primary Examiner*—John Niebling

*Assistant Examiner*—Brian M. Bolam

*Attorney, Agent, or Firm*—Burgess, Ryan & Wayne

[57] ABSTRACT

An acidic pretreating solution for silver plating, which comprises as an agent for preventing the silver deposition by displacement, an inorganic acid and/or an organic acid, and a silver plating process which uses this pretreating solution. The pretreating solution provides long lasting preventive effect against silver deposition by displacement and the resulting silver plated layer firmly adheres to a metal substrate surface.

9 Claims, No Drawings

PRETREATING SOLUTION FOR SILVER PLATING AND SILVER PLATING TREATING PROCESS USING THE SOLUTION

FIELD OF THE INVENTION

The present invention relates to a pretreating solution for silver plating on surfaces of metallic substrates and to the process for the pretreatment of metallic substrate surfaces using said pretreating solution.

This invention is particularly useful for silver plating of lead frames and other electronic components and materials.

BACKGROUND OF THE INVENTION

Recently, highs-speed partial plating has been widely applied in silver plating of electronic components and materials such as lead frames. However, direct plating of electronic components and materials usually results in poor adhesion to the substrates. Therefore, conventional high-speed silver plating is carried out after treating these substrates by copper strike plating. One characteristic feature of the plating solution using this process is a very high silver concentration. When a substrate material made of less-noble metal than silver, such as copper or copper alloy, is immersed in the plating solution of high silver concentration, a large amount of silver is deposited by a displacement reaction merely by the immersion of the substrate. The deposited silver layer by displacement on the substrate usually shows extremely poor adhesion, and the poor adhesion could not be improved by successive electroplating. The poor adhesion causes subsequently formed electroplates of silver to scale off or blister or tarnish upon heating, and results in detecting plating. Moreover, in partial plating, even the portions that need not be plated become plated, consuming the expensive silver wastefully. A further disadvantage is the contamination of the plating bath with ions of copper or other less-noble metals that have dissolved out of the substrate by the displacement reaction with silver.

To prevent such harmful deposits of silver by displacement, the inventors of the present invention have proposed a process of pretreatment and a pretreating solution for substrates to be plated with a solution containing thiocarboxylic acid or salts thereof (Japanese Laid Open Patent Application No. 190589/1985), nitrogen containing heterocyclic compounds such as 2,2'-dipyridyl (Japanese Laid Open Patent Application No. 190591/1985) and cyclic compounds whose ring includes a thioureylene radical such as 2-thiobarbituric acid (Japanese patent Publication No. 32318/1989) and other ingredients.

The pretreatment process using the above mentioned solutions requires one additional step by dividing the high-speed silver plating process into pretreating and plating processes.

However, the process provides the following advantages in comparison to the one step process, which adds an agent to the silver plating solution for the prevention of silver deposition by the displacement.

(1) Metal dissolution into silver plating solution by immersing the metallic substrate, which occurs in a very short period of time before the expression of the effects of the agent for preventing the silver deposition by displacement, can be prevented.

(2) Mixing the agent for preventing the silver deposition by displacement into the silver plating solution can be prevented.

(3) Therefore, the mixing of the components in the agent for preventing the silver deposition by displacement into the silver electroplated layer can be prevented.

(4) Harmful action in plating work that may be caused by mixing the agent for preventing the silver deposition by displacement into the silver plating solution can be prevented.

However, it became clear that KCN in the copper strike plating treatment solution is transferred into the pretreating solution and accumulates therein by repeated uptake of a very small amount of KCN from the copper strike plating treatment solution for a long period of time. The preventive effect of the silver deposition by displacement in the pretreating solution declined due to this accumulated KCN. This accumulation of KCN presented a new problem to be solved.

The transferring of KCN cannot be prevented completely, even if the metallic substrate is thoroughly washed with water after copper strike plating treatment.

When the KCN concentration in the pretreating solution becomes more than 25 mg/l, the thin film of the agent on the substrate for preventing the silver deposition by displacement is partially damaged or scaled off by KCN or a combination of the agent with KCN loses the preventive effect against the silver deposition by displacement. The effect can not be recovered even if the agent for preventing the silver deposition by displacement is replenished. Therefore, satisfactory quality silver plating cannot be obtained by high-speed silver plating due to the deposition of silver by displacement in the damaged portions.

Therefore, operation of plating has to be stopped occasionally to replace the pretreating solution or the high-speed silver plating solution is under serious condition.

Generally, the conventional copper strike plating solution approximately composed of CuCN: 90 g/l, KCN: 145 g/l and KOH: 90 g/l. The approximate composition of the normal high-speed silver plating solution is $KAg(CN)_2$: 130 g/l, $K_2HPO_4$: 100 g/l and pH range of 8 to 9. Both compositions are alkaline. Therefore, pretreating solution between the two solutions is generally used under alkaline conditions containing 0.1 to 20 g/l of KOH or NaOH, or adding a pH buffer such as $K_2HPO_4$.

The object of the present invention is to provide a pretreating solution for silver plating, which does not reduce the effect for preventing the silver deposition by displacement, even if operation of plating is repeated for a long period of time.

In other words, the purpose of the invention is to provide the pretreating solution for silver plating, which has a long effective life for preventing the silver deposition without replenishment.

One further purpose of the present invention is to provide a pretreating solution for silver plating, which enhances adhesion of the silver plating layer on metallic substrate surfaces.

Another purpose of the invention is to provide a pretreating solution for silver plating, which can reduce the loss of silver in silver plating solution.

Yet another purpose of the present invention is to provide a silver plating treatment process using such a pretreating solution for silver plating.

SUMMARY OF THE INVENTION

In order to accomplish the above-mentioned purposes, the inventors have investigated the reduction of the effect for the prevention of the silver deposition by displacement by the accumulation of KCN in the pretreating solution for silver plating mentioned above. As a result, it was unexpectedly discovered that, contrary to the common knowledge in this technology to use an alkaline pretreating solution for silver plating, the silver deposition by displacement can be completely inhibited by acidifying the solution by adding an acid. This discovery has lead to the present invention.

The present invention relates to an acidic pretreating solution for silver plating, which comprises (1) an agent for preventing the silver deposition by displacement reaction, and (2) an inorganic acid and/or an organic acid, and, if necessary, alkali metal salts of these acids.

The present invention also relates to a silver plating process which uses said pretreating solution for silver plating.

DETAILED DESCRIPTION OF THE INVENTION

The metallic substrates that can be silver plated by the present invention include various metals that are less-noble than silver; e.g. copper, copper alloys, iron, ferroalloys, nickel alloys, and substrates plated with them. Such metallic substrates re used as electronic components and materials such as lead frames.

Generally, these substrates are degreased, acid pickled and are copper strike plated prior to the plating by the present invention.

The copper strike plating conditions are well known to those in the art and can be selected suitably in accordance with their intended purpose.

The metal substrate treated by the above-mentioned copper stroke plating process is washed with water and then dipped in the pretreating solution for silver plating of the present invention.

As mentioned earlier, the pretreating solution for silver plating of the invention comprises (1) an agent for preventing the silver deposition by displacement reaction, and (2) an inorganic acid and/or an organic acid and should be acidic. The acidity of the pretreating solution in the invention is defined to be in the pH region below pH 7, which decomposes cyanides such as KCN. Preferably the pH range is 1 to 6, and more preferably 3 to 5.

Any inorganic or organic acid can be used as an acid to make the pretreating solution acid. These acids can be used alone or in combination.

Inorganic acids, such as sulfuric acid, nitric acid, hydrochloric acid, phosphoric acid can be listed as examples. Organic acids such as citric acid, sulfamic acid, acetic acid and tartaric acid can be used. These acids are illustrated as examples and no particular condition is required for the selection of acids.

However, phosphoric acid and citric acid are particularly preferable in consideration of the effects on the high-speed silver plating solution in the following process and the surfaces to be plated.

The acidity of the pretreating solution decomposes cyanides, e.g. KCN, which were incorporated from the preceding process and the formed HCN can be evaporated and removed without accumulation in the solution. Thus the effect of preventing the silver deposition by displacement in the pretreating solution can be maintained to greatly lengthen its life. For this purpose, the temperature of the pretreating solution is maintained at 10° to 80° C., more preferably at 20° to 40° C. and an equipment to absorb the evolved HCN and to recover or decompose it will be required. Generally, such facilities are provided for high-speed silver plating with a cyanic-bath and do not specially require their additional installation.

If the agent of preventing the silver deposition by displacement, used in the invention cannot be dissolved directly in the above mentioned acids, the required pH can be obtained by acidification to the desired pH with a suitable acid shown above, after dissolving the agent in an alkaline solution such as KOH or NaOH solution. In this case, the pretreating solution of the invention comprises (1) an agent for preventing the silver deposition by displacement, (2) an inorganic acid and/or an organic acid, as well as an alkali salt of the above mentioned inorganic and/or organic acid. If the agent cannot be dissolved by an acidic or alkaline solution, an organic solvent such as alcohol may be used.

Any known agent for preventing the silver deposition by displacement, used in the invention, can be used. Some typical examples are described below.

(a) A cyclic compound whose ring includes a thioureylene radical, which can be expressed by the following general formula, and its derivatives:

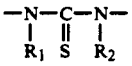

(wherein, $R_1$ and $R_2$ are each hydrogen, an alkyl group or an allyl group,

Typical cyclic compounds include 2-imidazolidinethione, barbituric acid, 2-thiobarbituric acid, 1-allyl-2-thiourea, 1-phenyl-2-tetrazolin-5-thione, 2-thiourasil, 4-thiouramil, and their derivatives such as salts, As described in for example, Japanese patent Publication No. 32318/1989.

(b) Thiocarboxylic acid and its derivatives. These compounds include thiocarboxylic acid, thiobenzoic acid, 2-mercaptopropionic acid, 2-ethylhexanoic acid, and their derivatives such as salts, as described in, for example, Japanese Laid Open Patent application No. 190589/1985

(c) Heterocyclic compounds containing a nitrogen atom and their derivatives.

These compounds include purine, adenine, 1,10-phenanthroline, 2,2'-dipyridyl, benzotriazole, 1,2,3-benzotriazole, 1-hydroxybenzotriazole, 5,6-dimethylbenzotriazole, 5-benzotriazolecarboxylic acid, 8-quinolinol, 2,4,6-tri-2-pyridyl-1,3,5-triazine and their derivatives such as their salts as described in, for example, Japanese Laid Open Patent Application No. 190591/1985.

(d) Rhodanine and its derivatives

These compounds include rhodanine, 3-amino-rhodanine and their derivatives such as their salts. As described in, for example, Japanese Laid Open Patent Application No. 190592/1985.

(e) Mercaptan compounds and their derivatives.

These compounds include thiolactic acid, thioglycol, thiomalic acid, thiosalicylic acid, 2-mercaptobenzothiazole, 2-mercapto-4-pyrimidine and their derivatives such as salts as described in, for example, Japanese Patent Publication No. 55237/1983 and Japanese Laid Open Patent Application No. 43995/1982.

(g) Dithiocarbamic acid, thiosemicarbazide and their derivatives.

These compounds include diethyldithiocarbamic acid, dimethyldithiocarbamic acid, N-methylthiocarbamic acid, ethylene-bisdithiocarbamic acid, 4-ethyl-3-thiosemicarbazide, 4-naphthyl-3-thiosemicarbazide, 1,4-diphenyl-3-thiosemicarbazide, 1-methyl-4-phenyl-3-thiosemicarbazide, 1-methyl-4-ethyl-3-thiosemicarbazide and their derivatives such as their salts as described in, for example, Japanese patent Publication No. 15994/1984 and Japanese Laid Open Patent Application No. 140891/1982.

(g) Heterocyclic thione compounds and their derivatives.

These compounds include 3-thiourazole, 2-thiouramil, 4,6-dioxo-2-thiohexahydropyrimidine, 2,6-dioxo-4-thiohexapyrimidine and their derivatives such as their salts as described in, for example, Japanese Laid Open Patent Application No. 187695/1985.

The derivatives mentioned above in the description include salts of said compounds.

The amount of these agents to be added for preventing the silver deposition by displacement may be decided according to the combination of the solubility in the acid and the required concentration for preventing the silver deposition by displacement for the agent used. Usually, an amount of 50 mg/l is adequate for thiobarbituric acid, rhodanine, 1,2,3-benzotriazole, 8-quinolinol and 1,10-phenanthroline.

Therefore, generally, an addition of 5 to 200 mg/l is considered sufficient. Under certain conditions, an addition of 1 to 10 g/l may be used. The appropriate selection of the amount may vary for each agent to secure satisfactory prevention of the silver deposition by displacement.

The pretreating solution for silver plating of the invention aims at inhibiting the silver deposition due to displacement of silver by the action of a very small amount of the component in the pretreating solution, which is absorbed on the surface of the metallic substrate. The substrate treated with said copper strike plating has only to be dipped in the pretreating solution for 3 to 30 seconds.

Between this pretreatment and silver plating, a step of washing with water may be interposed, but the practice of silver plating immediately after the pretreatment without the intermediate washing does not cause any problems.

The silver plating solution in accordance with the present invention is a high-speed silver plating solution having a silver concentration, in the form of an alkali silver cyanide, of 10 to 100 g/l and a free cyanide concentration of not more than 10 g/l. Among alkali silver cyanides, potassium silver cyanide gives the best result. In addition, the silver plating solution may contain boric acid or an alkali metal salt of phosphoric acid, pyrophosphoric acid, or citric acid as a salt effective in improving the electrical conductivity of the solution and in buffering the pH of the solution within the range of 7.5 to 9.0.

The successive silver plating will produce a plated deposit highly adherent, uniform and smooth with low hardness, which is optimum as plated silver deposit for electronic parts. The brightness is low, but if a highly bright silver plating deposit is desired, it is only necessary to add a brightening agent such a selenium compound. It is also not objectionable, according to the use intended, to add an antimony compound, EDTA, surface active agent and/or other ingredients known to those skilled in the art so as to improve the properties of the plated layer or the plating condition.

As described above, the pretreating solution for silver plating of the invention prevents the accumulation of cyanides such as KCN by acidifying the solution, and greatly lengthens the available period of the solution to enable continuous operation for along period of time. The agent for preventing the silver deposition by displacement is consumed only by adsorption on the substrate and by carrying outside, and can be managed by continuous supplementation. The preventive effect against silver deposition caused by displacement are equipotent to those of alkaline baths, so that the adhesiveness of the silver plated film on the substrate can be enhanced and can prevent the loss of silver.

The available period of pretreating solution varies in accordance with the treatment capacity of the plating facility and other factors, if pretreating is performed under alkaline condition. As one example, the available period of an alkaline pretreating solution for treating 70,000 $dm^2$/day has been one to three days. While, the available period of the acidic pretreating solution of the invention can be nearly semi-permanent and may rather be influenced by the life of the plating solution used in the following high-speed silver plating.

Examples of the invention will now be explained.

EXAMPLE 1

Lead frames made of a copper alloy substrate and treated by copper strike plating were washed with deionized water and were dipped for 10 seconds in various pretreating solutions containing 100 mg/l of 2-thiobarbituric acid and several varied pH and KCN concentrations at a solution temperature of 30° C. After washing with running deionized water for 10 seconds, the lead frames were immersed in a high-speed silver plating solution containing 130 g/l of $KAg(CN)_2$ and 100 g/l of $K_2HPO_4$ and adjusted pH=8.5 for 15 second at a solution temperature of 60° C. The lead frames were then washed with deionized water and were examined silvers deposits formed by displacement on the copper strike plated surface and the amount of silver deposits was determined by analyzing the nitric acid solution which dissolved silver deposits. KOH and phosphoric acid were used as the pH adjusting agents.

The results are shown in Table 1.

TABLE 1

| No. | Pretreating solution (pH) | KCN added amount (g/l) | Appearance | Amount of silver deposits ($mg/dm^2$) | Judgment |
|---|---|---|---|---|---|
| 1 | 10 | 0 | Good | 0.03 | Good |
| 2 | 10 | 0.025 | Bad | 0.63 | Bad |
| 3 | 2 | 0.025 | Good | 0.05 | Good |
| 4 | 3 | 0.50 | Good | 0.04 | Good |
| 5 | 3 | 2.50 | Good | 0.05 | Good |
| 6 | 4 | 2.50 | Good | 0.03 | Good |
| 7 | 6 | 0.50 | Good | 0.03 | Good |

Note: Appearance; Surface observation of plated lead frames whether silver deposits and turned white. Amount of silver deposits; Silver deposits can be observed by appearance when the deposited amount exceeds 0.1 $mg/dm^2$.

Sample No. 1 is a conventional alkaline type solution containing no KCN and the resultant silver plated sample showed no apparent problems. However, sample No. 2 added with 0.025 g/l of KCN deposited a large amount of 0.63 mg/dm$^2$ of silver and the plating procedure resulted in poor adhesion of silver layer. The amount of silver deposits in samples No. 3 to 7 of this invention were very small (0.03 to 0.05 mg/dm$^2$,) regardless of the amount of KCN added, at a pH of 2 to 6 with satisfactory appearances, as shown in Table 1.

EXAMPLE 2

The deposited amount of silver was examined by a method similar to that used in the Example 1. However, 100 mg/l of 2,2'-dipyridyl as the agent for preventing the silver deposition by displacement and the pH adjusting agents shown in Table 2 were used instead of the agents used in Example 1.

The results are shown in Table 2.

TABLE 2

| No. | Pre-treating solution (pH) | pH adjusting agent | KCN added amount (g/l) | Appearance | Amount of silver deposits (mg/dm$^2$) | Judgment |
|---|---|---|---|---|---|---|
| 1 | 3 | Phosphoric acid | 0.50 | Good | 0.05 | Good |
| 2 | 4 | Hydrochloric acid | 0.50 | Good | 0.06 | Good |
| 3 | 4 | Sulfuric acid | 0.50 | Good | 0.05 | Good |
| 4 | 4 | Citric acid | 0.50 | Good | 0.04 | Good |
| 5 | 5 | Sulfamic acid | 0.05 | Good | 0.07 | Good |
| 6 | 11 | KOH | 0.50 | Bad | 2.26 | Bad |

Samples No. 1 to 5 of the present invention gave very small amounts of silver deposits with good appearances, 0.04 to 0.07 mg/dm$^2$, regardless of the pH adjusting agent with the KCN concentration of 0.50 g/l, except for the sample No. 6 (pH=11).

What is claimed is:

1. An acidic pretreating solution for silver plating, said solution comprised of:

(1) at least one agent for preventing the deposition of silver, said agent being selected from the group consisting of;

(a) cyclic compounds whose ring includes a thioureylene radical and derivatives thereof, (b) heterocyclic compounds containing a nitrogen atom and derivatives thereof composed of purine, adenine, 1,10-phenanthroline, 2,2'-dipyridyl benzotriazole, 8-quinolinol 2,4,6-tri-2-pyridyl-1,3,5-trazine, (c) rhodanine and derivatives thereof, and (d) heterocyclic thione compounds and derivatives thereof, composed of 3-thiourazole,2-thiourasil,2-6-dioxo-4-thiohexahydropyrimidine; and (2) at least one acid selected from the group consisting of an inorganic acid, an organic acid and mixtures thereof, wherein the pretreating solution has a pH of from 1 to 6.

2. The pretreating solution of claim 1 further comprising an alkali metal salt of said acid.

3. The pretreating solution of claim 1 wherein the inorganic acid is selected from the group consisting of sulfuric acid, a nitric acid, hydrochloric acid and phosphoric acid.

4. The pretreating solution of claim 1 wherein the organic acid is selected from the group consisting of citric acid, sulfamic acid, acetic acid and tartaric acid.

5. The pretreating solution of claim 1 wherein the pretreating solution has a pH of from 3 to 5.

6. A silver plating method comprising copper strike plating the surface of a metal made of a metal less noble than silver, dipping the copper strike plate substrate in the acidic pretreating solution of claim 1 and silver plating the dipped substrate.

7. The method of claim 7 wherein the less noble metal is selected from the group consisting of copper, copper alloys, iron, ferro alloys, nickel alloys and metals plated with said less noble metal.

8. The method of claim 6 comprising dissolving the agent in an alkali metal hydroxide solution or an organic solvent.

9. The method of claim 6 comprising conducting the step of dipping the substrate in the pretreating solution at a temperature of from 10° to 80° C.

* * * * *